US007628513B2

(12) United States Patent
Chiu

(10) Patent No.: US 7,628,513 B2
(45) Date of Patent: Dec. 8, 2009

(54) LED LAMP STRUCTURE

(75) Inventor: Chia-Fa Chiu, Taoyuan (TW)

(73) Assignee: Primo Lite Co., Ltd., Taoyuan (TW)

( * ) Notice: Subject to any disclaimer, the term of this patent is extended or adjusted under 35 U.S.C. 154(b) by 175 days.

(21) Appl. No.: 11/826,783

(22) Filed: Jul. 18, 2007

(65) Prior Publication Data

US 2008/0123341 A1 May 29, 2008

(30) Foreign Application Priority Data

Nov. 28, 2006 (TW) ..... 95220939 U

(51) Int. Cl.
*F21V 3/00* (2006.01)

(52) U.S. Cl. ..... 362/311.02; 362/240; 362/294; 362/311.01; 362/311.09; 362/311.11; 362/373; 362/800

(58) Field of Classification Search ..... 362/240, 362/294, 311.373, 800, 311.01, 311.02, 311.06, 362/311.09, 311.11, 73; 361/688, 690, 704, 361/707, 719

See application file for complete search history.

(56) References Cited

U.S. PATENT DOCUMENTS 6,367,949 B1 * 4/2002 Pederson ..... 362/240
6,598,996 B1 * 7/2003 Lodhie ..... 362/249
6,948,829 B2 * 9/2005 Verdes et al. ..... 362/227
2005/0111234 A1 * 5/2005 Martin et al. ..... 362/555
2006/0193139 A1 * 8/2006 Sun et al. ..... 362/373
2006/0215408 A1 * 9/2006 Lee ..... 362/294

* cited by examiner

*Primary Examiner*—Sandra L O'Shea
*Assistant Examiner*—Meghan K Dunwiddie
(74) *Attorney, Agent, or Firm*—Bacon & Thomas, PLLC

(57) ABSTRACT

An LED lamp structure includes a housing, a support, an LED light source, a light source driving circuit board, a lens, and a cover. The housing has a horn-like shape with a converged end and a flared end, wherein the flared end is formed with an accommodation chamber; the converged end is arranged with a support, and the accommodation chamber receives an LED light source, a light source driving circuit board, and a lens; and the cover is engaged with the flared end of the housing. Given that the light source driving circuit board is located at the flared end of the housing with a larger space. As such, an improved cooling effect can be obtained and that the electronic components can be more durable and reliable. And the lens has a predetermined illuminating angle, so that a desirable illumination effect on the LED light source can be obtained.

15 Claims, 4 Drawing Sheets

LED LAMP STRUCTURE

BACKGROUND OF THE INVENTION

1. Field of the Invention

The present invention relates to a lamp structure in which LEDs are used as a light source, and more particularly, to an LED lamp structure adapted to direct driving and to increasing cooling effect.

2. Description of Related Art

Nowadays lamps available in the market, such as those modeled in GU10, E12, MR16 or E27 lampbase, are used to project light beams on articles so as to improve brightness, aesthetics, and displaying effect of the articles. Examples can be found in art galleries where art works and jewelries are illuminated with lamps. A light fitting is then formed with a lamp structure arranged into a frame.

FIG. 1 illustrates a perspective view of a conventional lamp structure; and FIG. 2 illustrates a cross-sectional view of the conventional lamp structure. A lamp structure 9, known as Model MR 16, comprises a reflector 91, a housing 92, and a support 93, wherein the reflector 91, the housing 92, and the support 93 are assembled in sequence, and two contacts 931 are arranged underneath the support 93.

A light source 921 and a lens 922 are arranged in the housing 92, wherein the light source 921 includes LEDs, and the lens 922 is located above the light source 921 for light condensing, such that light beams from the light source 921 are projected toward a particular (predetermined) direction.

A light source driving circuit board 932 is arranged inside the support 93, and is electrically connected with the light source 921 and with the contacts 931 underneath the support 93.

However, such a lamp structure 9 usually has a support 9 in a relatively small dimension. This is because when the light source driving circuit board 932 is arranged inside the support 93, the dimension of the light source driving circuit board 932 will no doubt be limited by inner space of the support 93. Under such a circumstance, the light source driving circuit board 932 can only be designed as small as possible in dimension. Likewise, for the electronic components mounted on the light source driving circuit board 932, design and assembly with the dimension of the electronic components minimized become very difficult.

Moreover, as known very well to persons in the technical field for the lamp structure 9, the light source driving circuit board 932 will produce more heat during operation. As a result, when the light source driving circuit board 932 is confined in a space of smaller dimension, cooling will be a very important issue; and since the support 93 is in a closing state, cooling becomes difficult for the light source driving circuit board 932. Thus the heat produced from the light source driving circuit board 932 will make components in the support 93 easily damaged. In particular, since she support 93 is usually made of plastics, the heat produced from the light source driving circuit board 932 will make the support 93 or other plastic components softened or even melted. This not only makes the lamp structure disable, but also shortens the life of the lamp structure (lowering reliability of the lamp structure 9).

SUMMARY OF THE INVENTION

An object of the present invention is to provide an LED lamp structure, comprising a housing, a support, an LED light source, a light source driving circuit board, a lens, and a cover. The housing has a horn-like shape with a converged end and a flared end, wherein the flared end is formed with an accommodation chamber. The support is arranged underneath the converged end of the housing and is provided with two contacts.

The LED light source is arranged at the accommodation chamber of the housing, and that the light source driving circuit board is arranged at the housing and inside the accommodation chamber, where the light source driving circuit board is connected with the LED light source and with the contacts of the support, respectively.

The lens is arranged inside the accommodation chamber of the housing, and is located above the LED light source. The cover is engaged with the flared end of the housing.

Further, given that the light source driving circuit board is arranged in the accommodation chamber which is located at the flared end of the housing with a larger space, minimization to the light source driving circuit board, as needed by the conventional art because of limited space, is unnecessary. As such, electronic components on the light source driving circuit board require only a normal dimension. In addition, a convenient assembly can be facilitated, and an improved cooling effect be obtained.

An improvement on ventilation prevents the light source driving circuit board from being damaged due to the heat produced from per se; nor the problem encountered by the conventional art occurs owing to an undesirable ventilation that the light source driving circuit board is confined in a narrow internal space of the support and that the electronic components on the light source driving circuit board may be softened or even melted. Therefore, the LED lamp structure according to the present invention can be more durable and reliable.

The cover may be made of plastics, or may be a translucent plastic one, or may be a metallic one.

The housing includes a wall surrounding the accommodation chamber, where the wall is provided with at least one vent, thereby improving cooling effect on the housing and on the light source driving circuit board which is located inside the housing. The at least one vent may be elongated, circular, square or others, providing the air circulation passway for heat convection.

The LED light source may be determined by condition of use, namely, option may be directed to greater luminous quantity, more energy saving, or longer life of use.

The lens has a predetermined illuminating angle, so that the light beams projected from the LED light source can be limited to a specific angle, upon a design on the illuminating angle. For example, a focusing effect may be made to the LED light source so that brighter light beams can be obtained; or a diffusion effect may be made, through designing a predetermined illuminating angle, so that softer light beams can be obtained. In other words, through a design on the lens for a predetermined illuminating angle, a desirable illumination effect on the LED light source can be obtained.

Other objects, advantages, and novel features of the present invention will become more apparent from the following detailed description when taken in conjunction with the accompanying drawings.

DETAILED DESCRIPTION OF THE PREFERRED EMBODIMENTS

Figure 3:
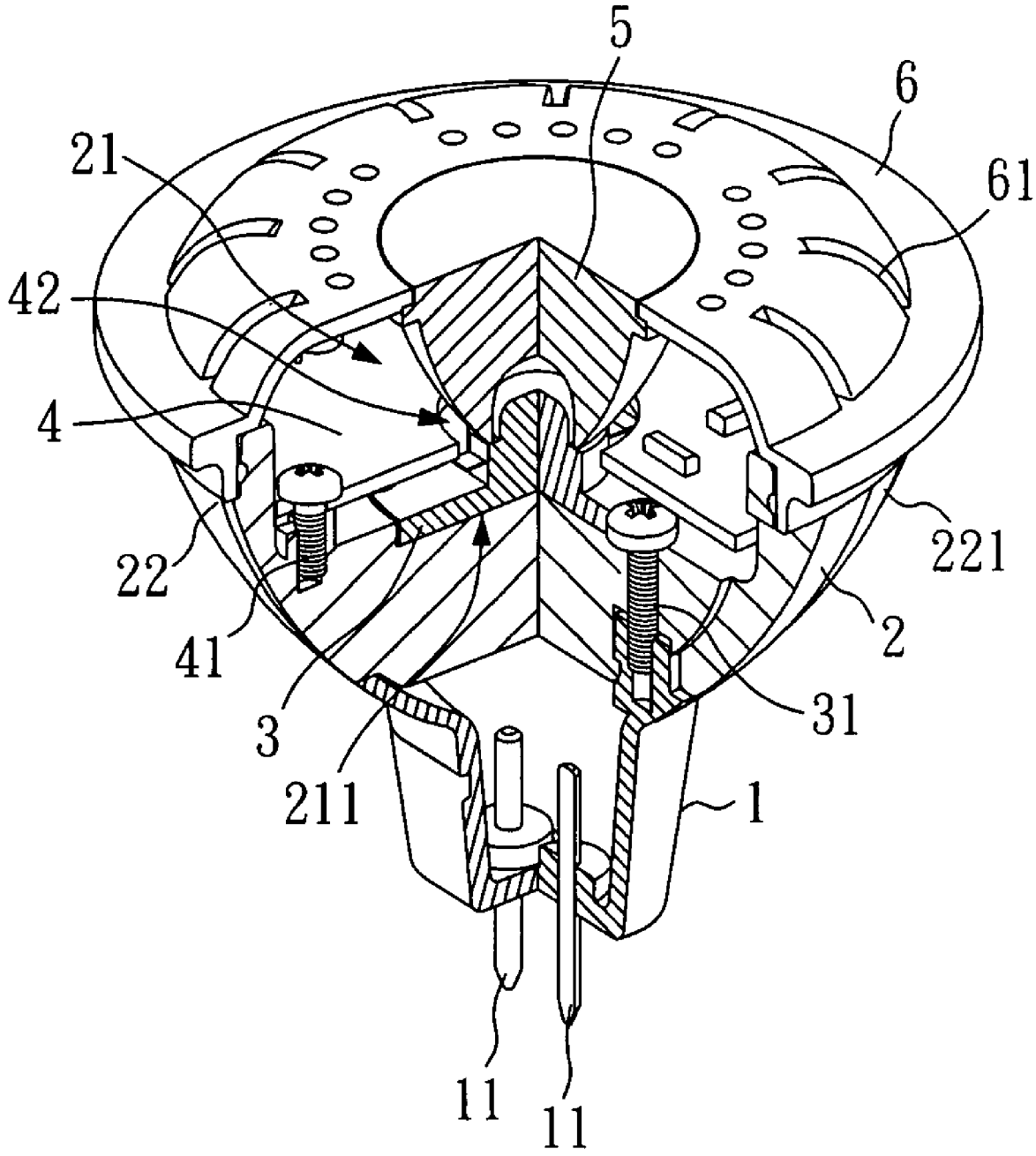
FIG. 3 illustrates a partially sectional perspective view of a lamp structure according to the present invention.
Figure 4:
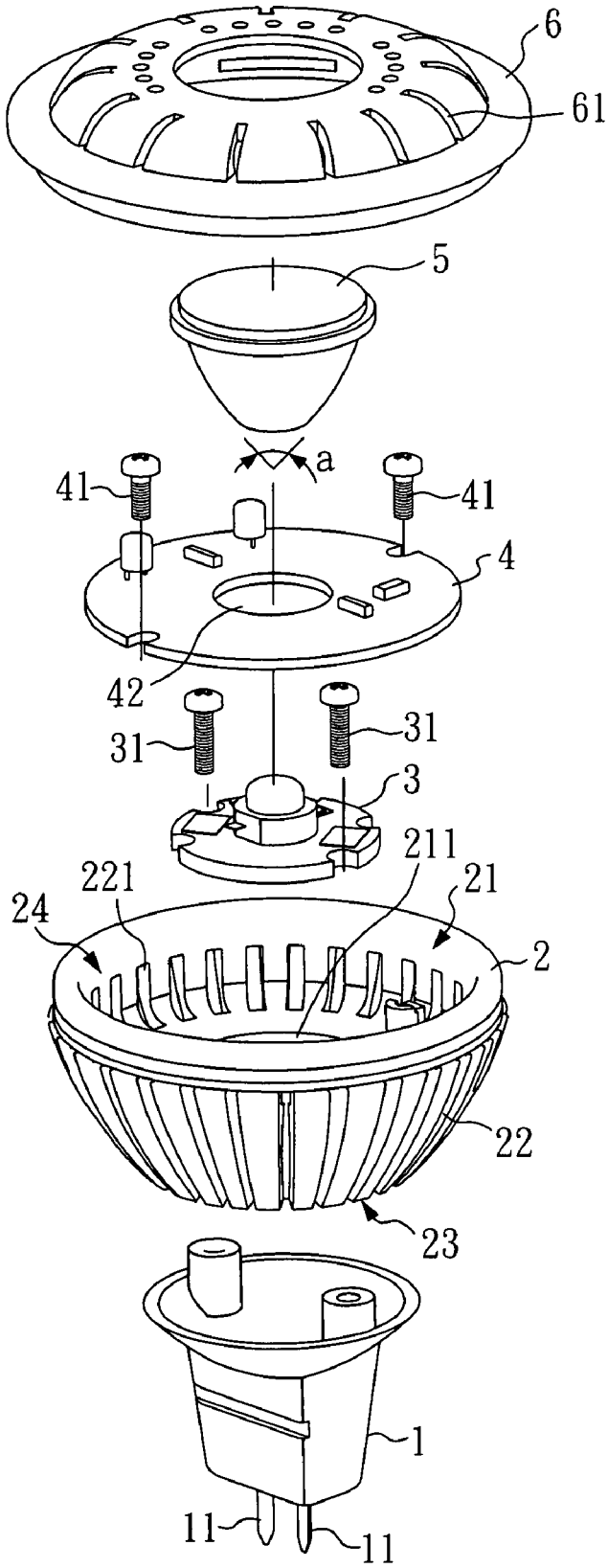
FIG. 4 illustrates an exploded view of the lamp structure according to the present invention.

Referring to FIGS. 3 and 4, the LED lamp structure exemplified as a preferred embodiment of the present invention relates to Model No. MR16. The LED lamp structure comprises a housing 2, a support 1, an LED light source 3, a light source driving circuit board 4, a lens 5, and a cover 6. As shown, the housing 2 has a horn-like shape with a converged end 23 and a flared end 24, wherein the flared end 24 is formed with an accommodation chamber 21 and a recessed portion 211.

The housing 2 is made of metal, or preferably in the present invention, aluminum, where the housing 2 includes a wall 22 surrounding the accommodation chamber 21. Further, the wall 22 is provided with a plurality of vents 221 communicating the accommodation chamber 21 with outside of the housing 2, where the vents 221 are each elongated. Alternatively, the vents 221 may be circular, square or others.

The support 1 is arranged underneath the converged end 23 of the housing 2, where the support 1 is provided with two needle-like contacts 11 extending downwardly from the support 1. As shown in FIGS. 3 and 4, the support 1 is affixed to the housing 2 at the converged end 23 in such a manner that the LED light source 3 is located at the accommodation chamber 21 and is arranged at the recessed portion 211. According to the present invention, the LED light source 3 is arranged at the accommodation chamber 21 of the housing 2, and at the recessed portion 211, with two screws 31. The screws 31 extend through the housing 2, respectively, and are secured to the support 1. As such, the support 1 can be affixed to the housing 2 at the converged end 23.

As shown in FIG. 4, the light source driving circuit board 4 according to the present invention is shaped as a donut, and is arranged at the housing 2 and inside the accommodation chamber 21, where the light source driving circuit board 4 is connected with the LED light source 3 and the contacts 11 of the support 1, respectively.

According to the present invention, the light source driving circuit board 4 includes a central hole 42, where the LED light source 3 is located at the central hole 42 and extends upwardly therefrom, so that light beams project outward from the central hole 42. The light source driving circuit board 4 is secured to the housing 2, at the accommodation chamber 21, by two screws 41 depending on necessarily.

The lens 5 is arranged inside the accommodation chamber 21 of the housing 2, and is located above the LED light source 3. According to the present invention, the lens 5 has a predetermined illuminating angle.

Further, the cover 6 is engaged at the flared end 24 of the housing 2 and encloses the accommodation chamber 21. The cover 6, upon engaging the flared end 24 of the housing 2, will press on the lens 5, so that the lens 5 can be received in the accommodation chamber 21 and be held in position above the LED light source 3. According to the present invention, the cover 6 is made of plastics and is engaged with the flared end 24 of the housing 2 by tight fit. Also, the cover 6 is provided with a plurality of vents 61 communicating the accommodation chamber 21 of the housing 2 with outside of the cover 6. The cover 6 may be a translucent plastic one, or may be a metallic one, or may be made of any other materials.

Given that the light source driving circuit board 4 is arranged in the accommodation chamber 21 which is located at the flared end 24 of the housing 2 with a larger space, minimization to the light source driving circuit board 4, as needed by the conventional art because of limited space, is unnecessary. As such, components on the light source driving circuit board 4 require normal dimension or better grade. In addition, a convenient assembly can be facilitated, and an improved cooling effect be obtained.

Figure 1:
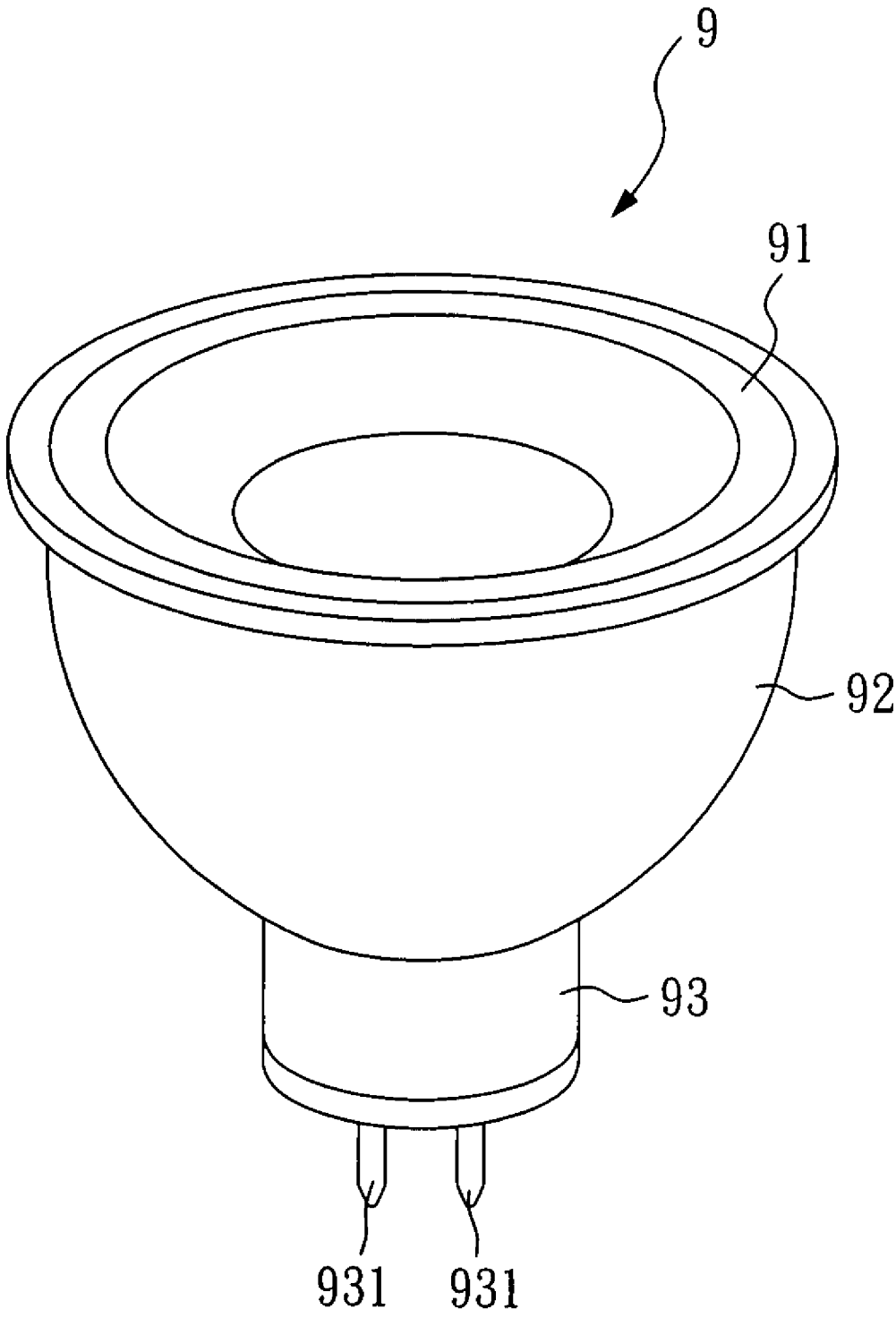
FIG. 1 (PRIOR ART)
FIG. 1 illustrates a perspective view of a conventional lamp structure.
Figure 2:
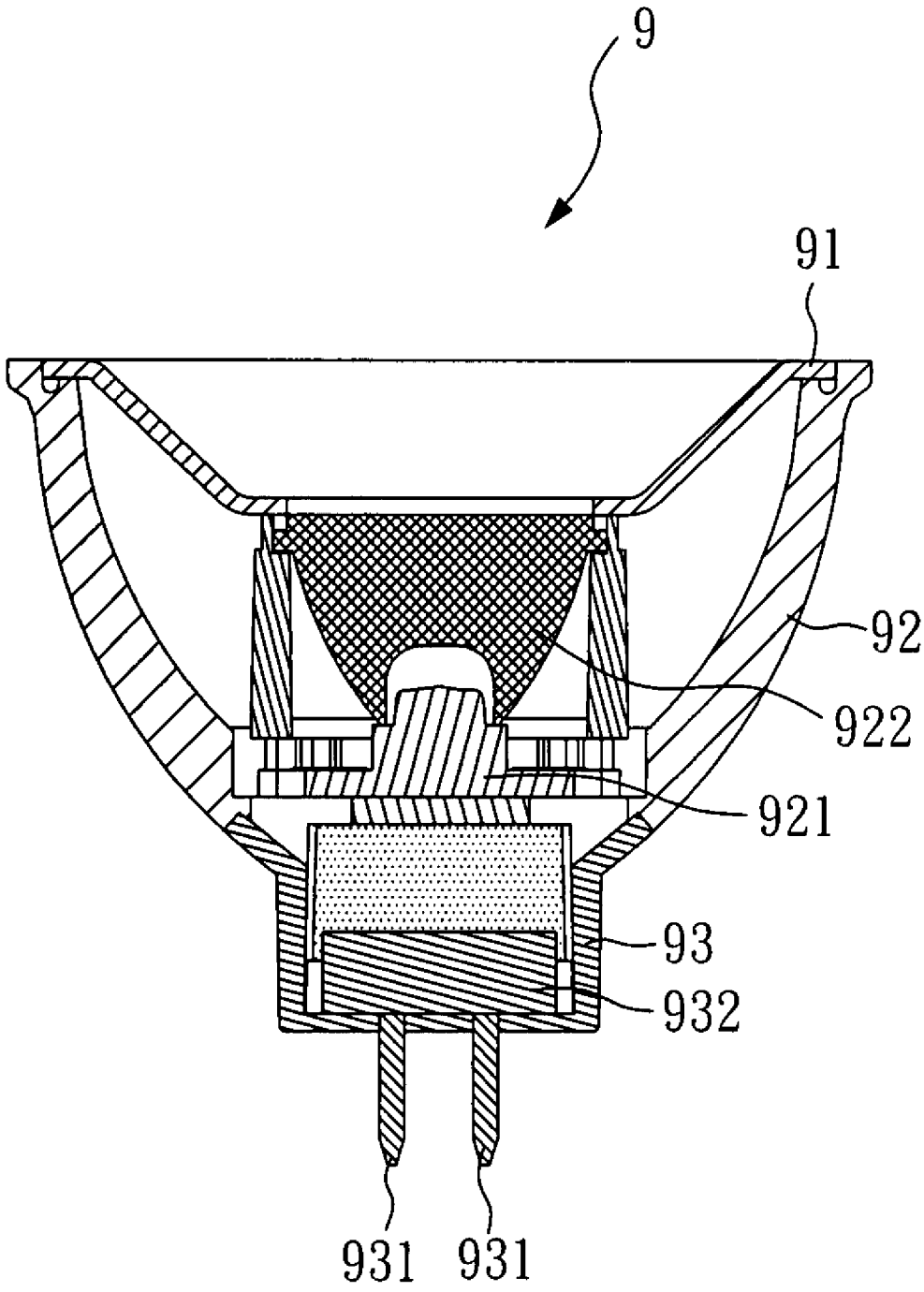
FIG. 2 (PRIOR ART)
FIG. 2 illustrates a cross-sectional view of the conventional lamp structure.

Such an improvement on ventilation will, of course, prevent the light source driving circuit board 4 from being damaged by the heat produced from per se; nor the problem encountered by the conventional art occurs owing to an undesirable ventilation that, as shown in FIGS. 1 and 2, the light source driving circuit board 932 is confined in the narrow internal space of the support 93, and that more seriously, electronic components on the light source driving circuit board 932 may be softened or even melted. Therefore, the LED lamp structure according to the present invention can be more durable and reliable.

Further, the housing 2 is made of aluminum with desirable thermal conduction, and that the wall 22 surrounding the accommodation chamber 21 is provided with a plurality of vents 221. Due to the aluminum housing 2 (thermal conduction) and the plural vents 221 (thermal convection), an improved cooling effect for the light source driving circuit board 4 can be obtained. Besides, since the cover 6 is provided with a plurality of vents 61, an improved ventilation effect to the light source driving circuit board 4 is obvious.

The LED light source 3 employed in the lamp structure according to the present invention can be determined by condition of use, namely, option may be directed to greater luminous quantity, more energy saving, or longer life of use.

The lens 5 may have a predetermined illuminating angle a, so that the light beams projected from the LED light source 3 can be limited to a specific angle, upon a design on the illuminating angle a. For example, a focusing effect may be made to the LED light source 3 so that brighter light beams can be obtained; or a diffusion effect may be made, through designing a predetermined illuminating angle a, so that softer light beams can be obtained. In other words, through a design on the lens 5 for a predetermined illuminating angle a, a desirable illumination effect on the LED light source can be obtained.

The above-mentioned LED lamp structure according to the present invention is not limited to the lamp structure carrying Model No. MR16, as exemplified herein, but is adapted to common light bulb with lampbase Model Nos. PAR16, PAR12, GU10, and GU5.3.

Although the present invention has been explained in relation to its preferred embodiments, it is to be understood that many other possible modifications and variations can be made without departing from the scope of the invention as hereinafter claimed.

What is claimed is:

1. An LED lamp structure, comprising:

a housing, having a horn-like shape with a converged end and a flared end which is formed with an accommodation chamber;

a support, arranged underneath the converged end of the housing and provided with two contacts;

a LED light source, arranged at the accommodation chamber of the housing;

a light source driving circuit board, arranged at the housing and inside the accommodation chamber, where the light source driving circuit board is connected with the LED light source and with the contacts of the support respectively, the light source driving circuit board includes a central hole, and the LED light source is located at the central hole and projects light beams outward from the central hole;

a lens, arranged inside the accommodation chamber of the housing, and located above the LED light source; and a cover, engaged with the flared end of the housing.

2. The LED lamp structure as claimed in claim 1, wherein the housing includes a wall surrounding the accommodation chamber, where the wall is provided with at least one vent.

3. The LED lamp structure as claimed in claim 2, wherein the at least one vent is elongated.

4. The LED lamp structure as claimed in claim 1, wherein a recessed portion is located in the accommodation chamber of the housing, and wherein the LED light source is arranged at the recessed portion.

5. The LED lamp structure as claimed in claim 1, wherein the LED light source is arranged at the accommodation chamber of the housing with at least one screw.

6. The LED lamp structure as claimed in claim 5, wherein the at least one screw extends through the housing and is secured to the support.

7. The LED lamp structure as claimed in claim 1, wherein the light source driving circuit board is secured to the housing, at the accommodation chamber, by at least one screw.

8. The LED lamp structure as claimed in claim 1, wherein the lens has a predetermined illuminating angle.

9. The LED lamp structure as claimed in claim 1, wherein the cover is provided with at least one vent communicating the accommodation chamber of the housing with outside of the cover.

10. The LED lamp structure as claimed in claim 1, wherein the cover is engaged with the flared end of the housing by tight fit.

11. The LED lamp structure as claimed in claim 1, wherein the cover is made of plastics.

12. The LED lamp structure as claimed in claim 1, wherein the housing is made of metal.

13. The LED lamp structure as claimed in claim 1, wherein the light source driving circuit board is shaped as a donut.

14. The LED lamp structure as claimed in claim 1, wherein the light source driving circuit board is arranged in the accommodation chamber at the flared end of the housing.

15. The LED lamp structure as claimed in claim 2, wherein the at least one vent is circular or square.

* * * * *